US008164585B2

(12) United States Patent
Oh

(10) Patent No.: US 8,164,585 B2
(45) Date of Patent: Apr. 24, 2012

(54) DIGITAL VIDEO AND PHOTO GREETING CARD

(76) Inventor: Suk Joon Oh, Seongnam (KR)

( * ) Notice: Subject to any disclaimer, the term of this patent is extended or adjusted under 35 U.S.C. 154(b) by 994 days.

(21) Appl. No.: 12/111,232

(22) Filed: Apr. 29, 2008

(65) Prior Publication Data

US 2009/0211126 A1 Aug. 27, 2009

(30) Foreign Application Priority Data

Feb. 21, 2008 (KR) ..... 10-2008-0015970

(51) Int. Cl.
*G09G 5/00* (2006.01)

(52) U.S. Cl. ..... 345/204; 40/124.01

(58) Field of Classification Search ..... 345/204, 345/211, 156; 040/124.01, 124.03, 124.09, 040/124.13
See application file for complete search history.

(56) References Cited

U.S. PATENT DOCUMENTS 5,063,698 A * 11/1991 Johnson et al. ..... 40/124.03
5,502,463 A * 3/1996 Sasaki et al. ..... 345/204
6,525,706 B1 * 2/2003 Rehkemper et al. ..... 345/87
2004/0109015 A1 * 6/2004 Peng ..... 345/716
2004/0248073 A1 * 12/2004 Pinkerman et al. ..... 434/308

FOREIGN PATENT DOCUMENTS

KR 10-2001-0002185 1/2001
KR 20-0270724 4/2002

* cited by examiner

*Primary Examiner* — Jimmy H Nguyen
(74) *Attorney, Agent, or Firm* — Sherr & Vaughn, PLLC

(57) ABSTRACT

The present invention provides a digital video greeting card including video, photos and voice information as well as text, by inserting a main panel for outputting video and voice data into cards such as a greeting card, invitation card, etc. To this end, the present invention proposes a method of making the main panel thin and provides a switch for allowing the main panel to be operated according to the folding and unfolding operation of an outer cover. Further, an external data input section is formed in the video greeting card of the present invention so as to provide a function of connecting to an additional memory card, a memory device, etc. Accordingly, the present invention can provide a digital video greeting card compatible with other devices, etc.

8 Claims, 7 Drawing Sheets

【FIG. 1】
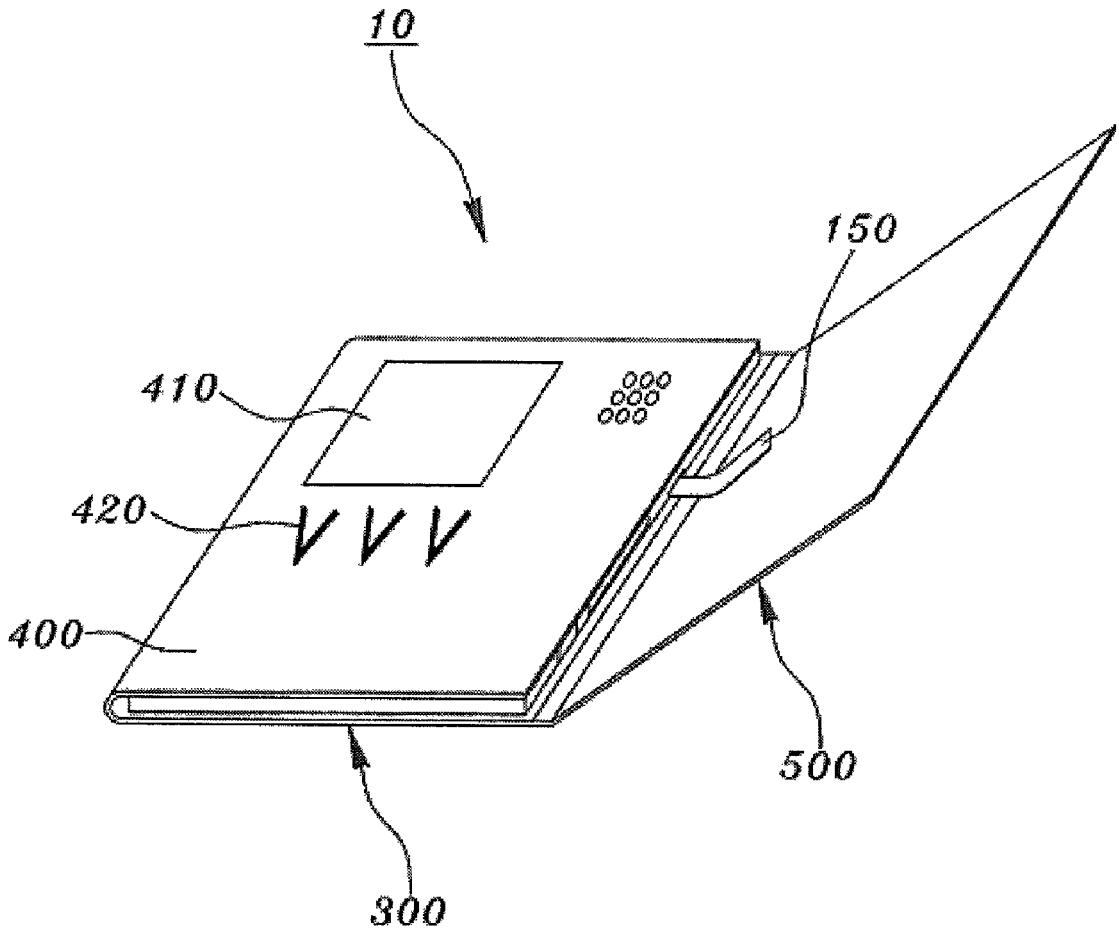

【FIG. 2】
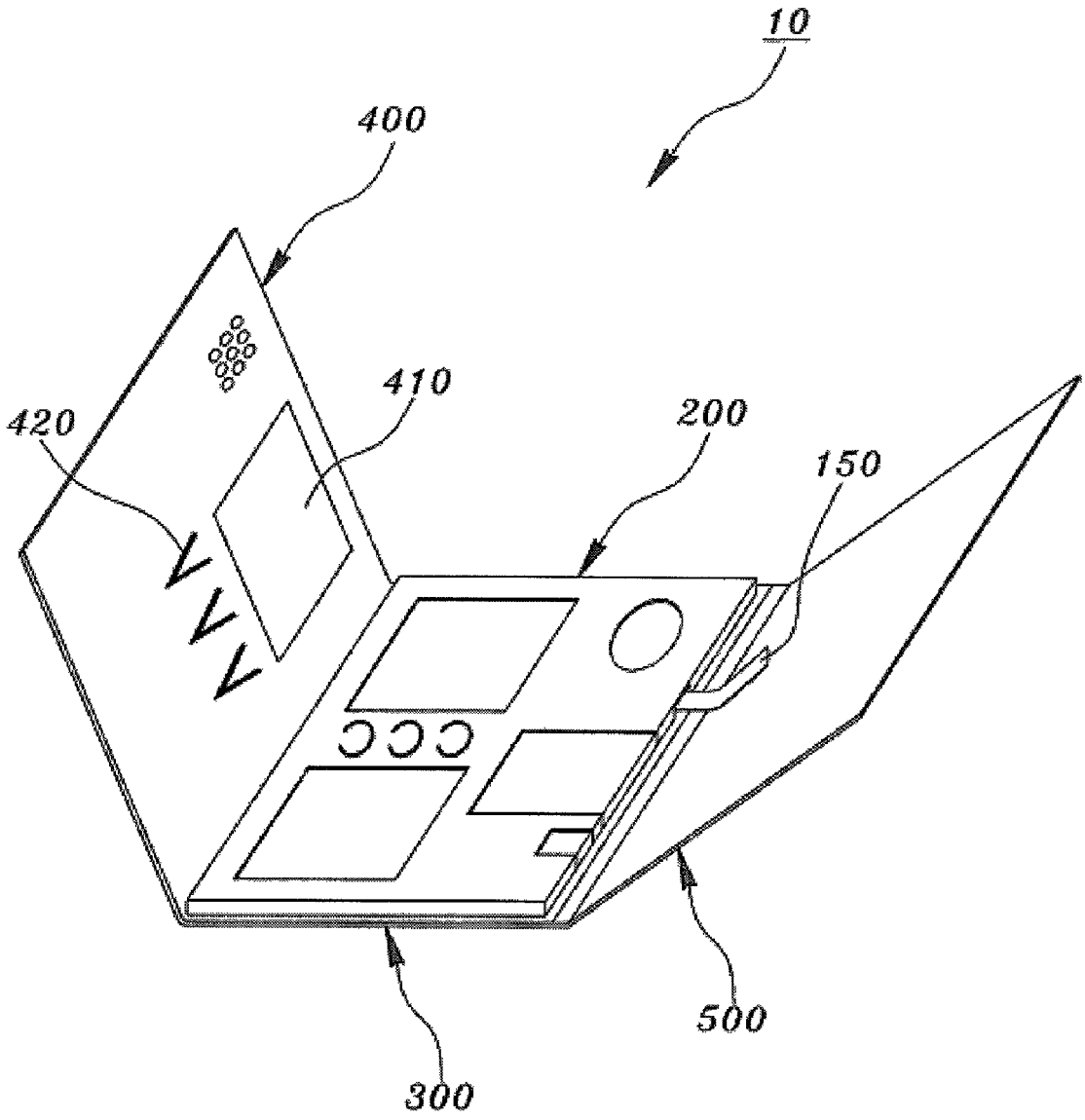

【FIG. 3】
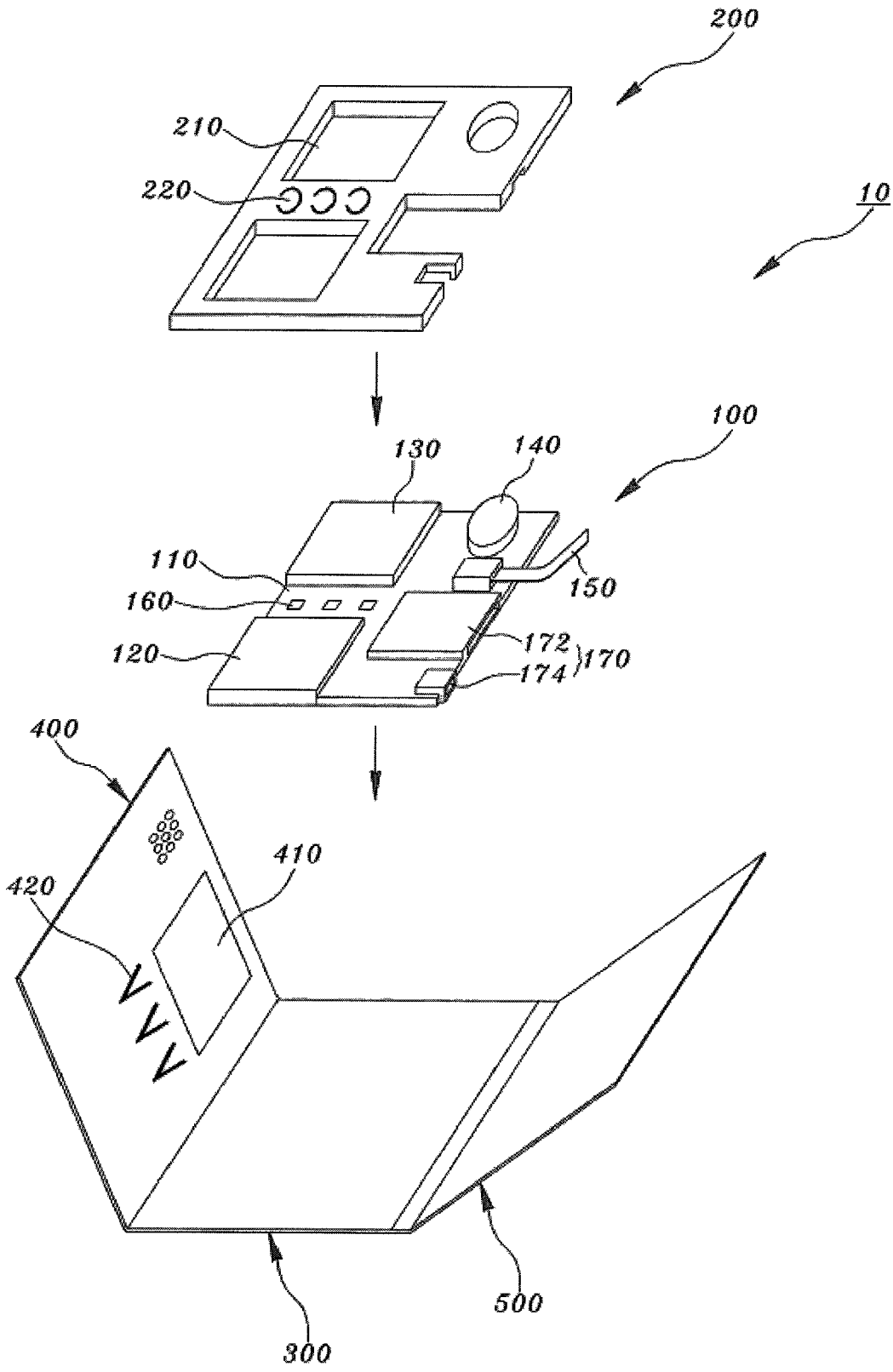

【FIG. 4】
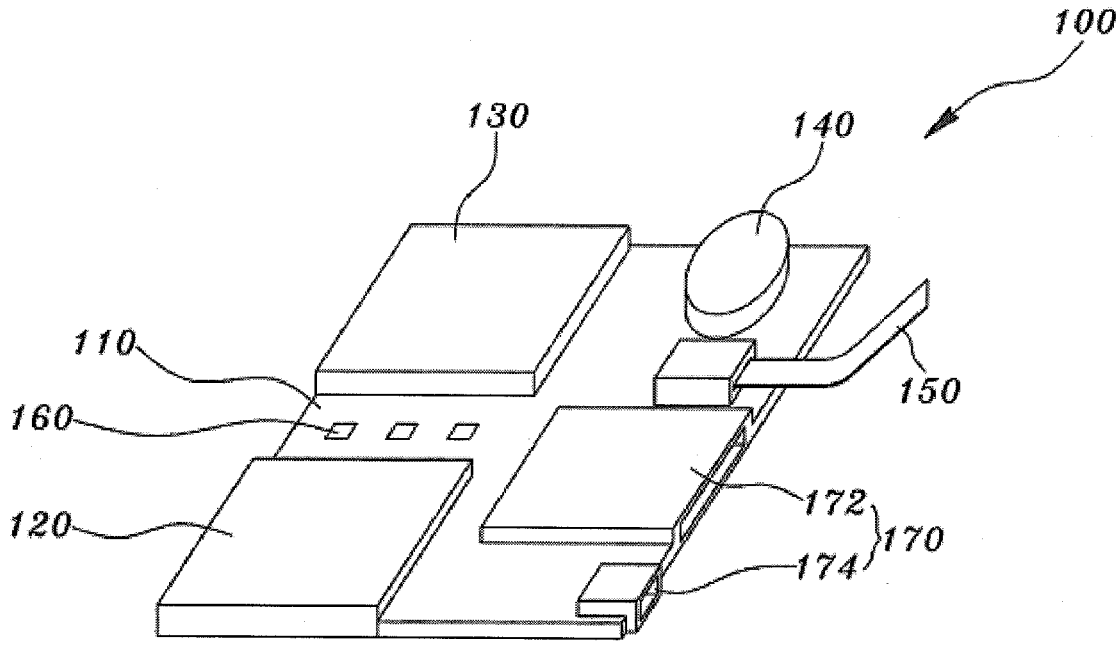

【FIG. 5】
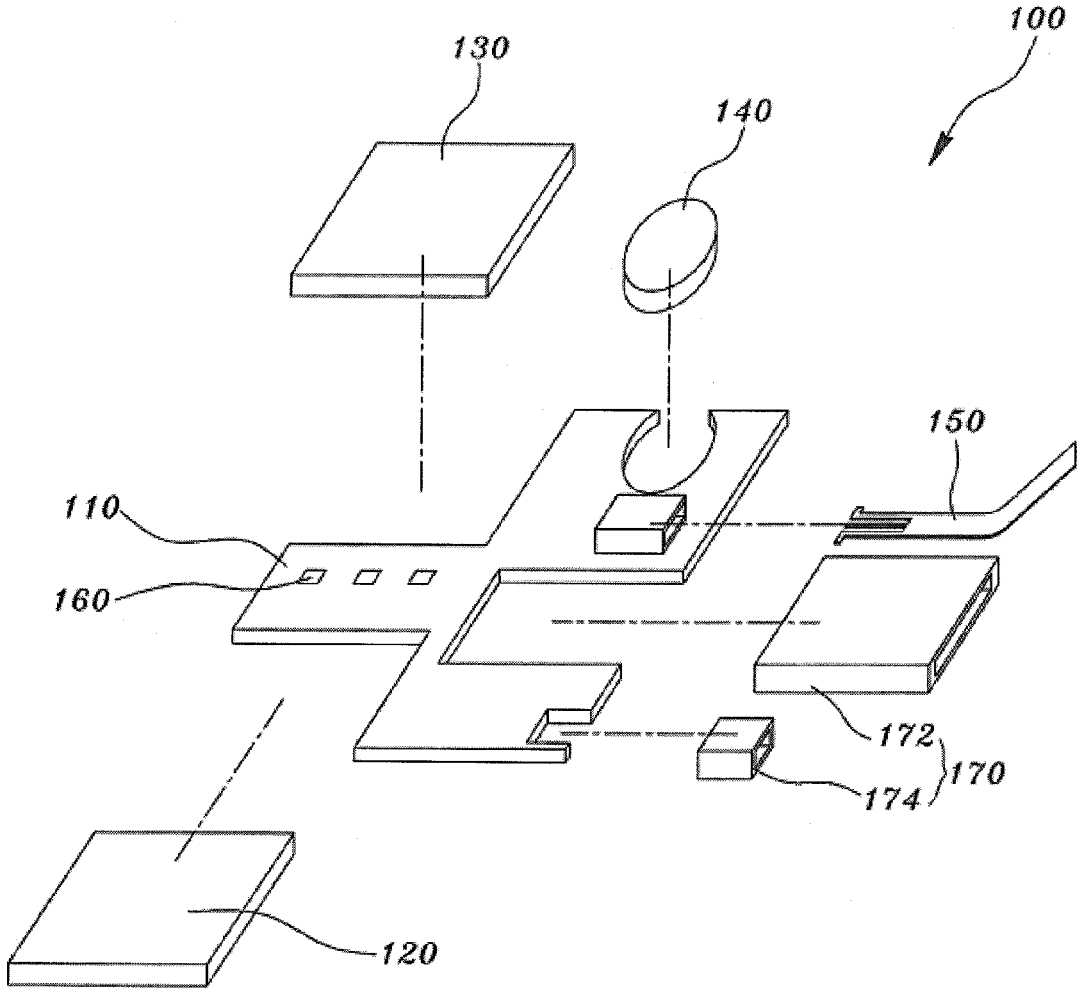

【FIG. 6】
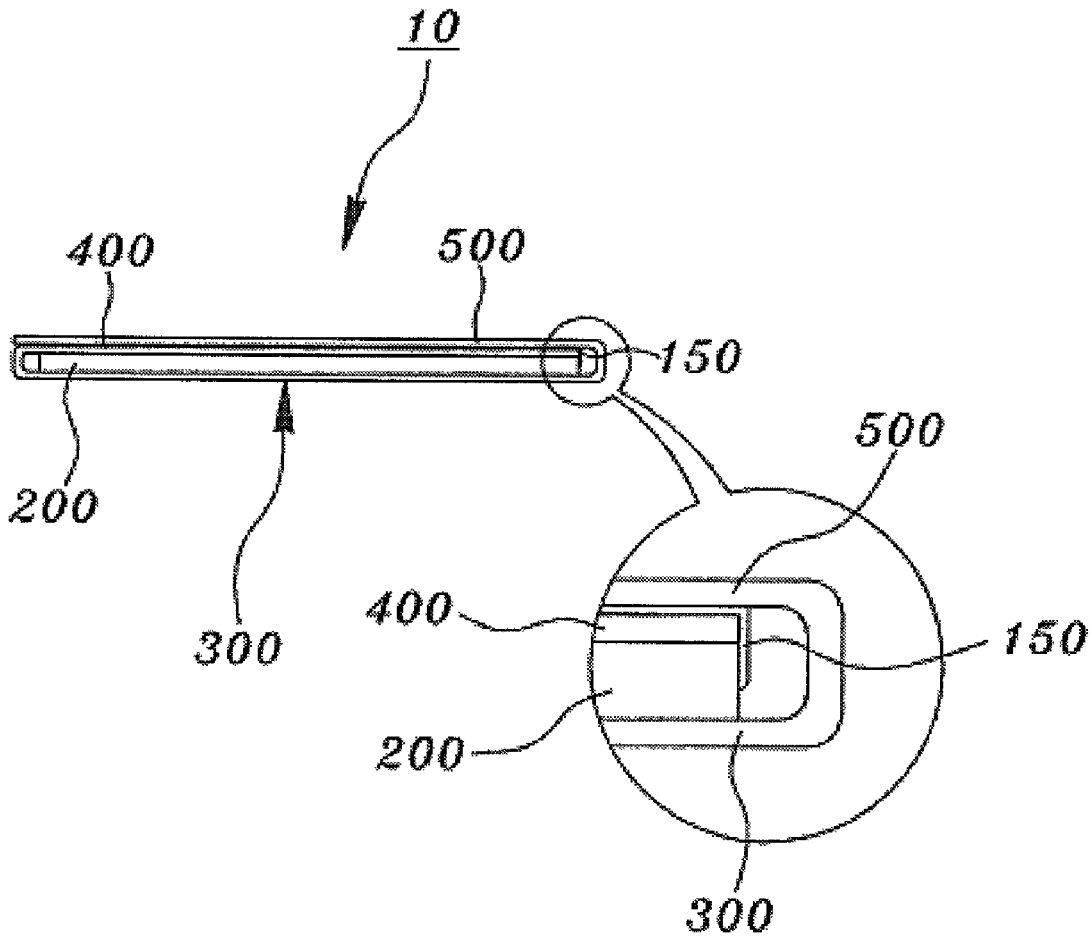

【FIG. 7】
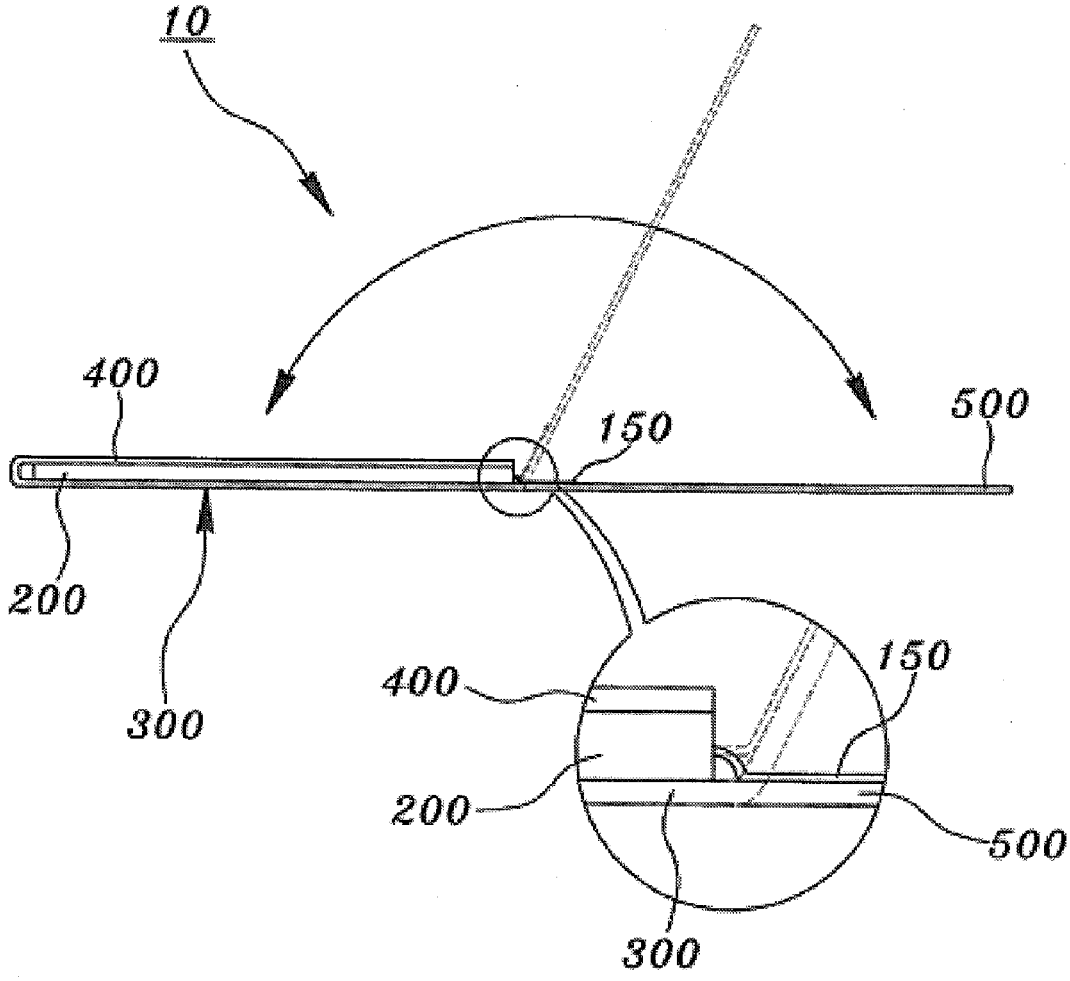

DIGITAL VIDEO AND PHOTO GREETING CARD

BACKGROUND OF THE INVENTION

1. Field of the Invention

This present invention relates to an improved greeting card that when opened, displays and plays digital videos, photo, and audio through an electronic display, utilizing a thin main panel circuit board.

The circuit board used in the card is very flat and thin and can be applied for use in books, catalogs, etc. In conventional cards, the sender expressed their wishes using words. However with this new invention, wishes and desires of the sender can be expressed through video, photos and voice, in addition to text written onto the card. Therefore, clear and accurate thoughts and emotions can be transferred to a person who receives information.

The video greeting card includes a main panel to which a component for outputting video and voice data is coupled, and a housing that surrounds and protects components of the main panel.

Furthermore, the bottom of the main panel and the attached housing together are protectively covered with a base cover, while the top surface of the main panel and attached housing are protected with a manipulation cover. The manipulation cover is then covered with an outside cover.

Accordingly, when the external cover (book cover, card stock, etc.) is opened, a switch connected to the external cover is actuated to output video and voice data. Thus, if a book, a catalog, etc., is unfolded in a state where the video greeting card is inserted into the book, the catalog, etc., the contents to be transferred to other persons are output as video and voice, rather than text alone. Therefore, a sender's wishes, desires, etc., which cannot be described using words can be easily transferred to other persons.

Further, the invention allows video, photos, voice data stored in other memory devices to be easily transferred onto the card using a number of input devices.

2. Background of the Related Art

Video continues to become an increasingly popular medium for content on the Internet. Greeting cards, invitation cards, etc., have previously been limited in their paper format to transfer information in the form of text only.

Other sources of text only information channels include books, catalogs, photo albums, etc. All are configured to transfer information in the form of texts, images, photos, etc., but is less effective at communicating the message than by employing video or voice.

There have recently been attempts to transfer information by combining the information material with video or voice; however the availability of these attempts is very low because the thickness of a main panel for outputting video and voice data and the weight is heavy due to the adoption of the battery, etc.

Furthermore, in cases where very important but complicated information has to be transferred, books or catalogs containing only texts and figures are not appropriate for transferring accurate information because they are merely used as reference materials for description.

In particular, greeting cards are used to express emotion, something that can easily be misunderstood through words alone.

SUMMARY OF THE INVENTION

Accordingly, the present invention has been made in view of the above problems occurring in the prior art, and it is the object of the present invention to provide a video greeting card, including video, photos and voice information, in addition to texts, by inserting a main panel for outputting video and voice data into a card, bound document, or tome such as a greeting card, an invitation card, brochure, catalog, book, and more.

In addition, this present invention proposes a method of making the main panel thin and provides a switch for allowing the main panel to be operated by folding and unfolding the outer cover.

Further, a data input section/port is formed in the video greeting card of the present invention so as to provide a function of connecting to an additional memory card, a memory device, etc. Accordingly, the present invention can provide a digital video greeting card compatible with other devices, etc.

To achieve the above objects, a digital video greeting card in accordance with the present invention includes: a main panel having a self-power source and a memory, the main panel being configured to output contents, which are stored in the memory, in the form of video, digital photos and voice; a housing coupled to the main panel and configured to cover a top portion of the main panel, wherein the housing includes a plurality of notches formed thereon so as to allow respective components of the main panel to be inserted like fitting puzzle pieces together. Components that make up the navigation buttons protrude through the main panel. A base cover is fixed to the bottom surface of the main panel and the housing which are coupled to each other. A manipulation cover connected to one side of the base cover and configured to fold over and cover the top surfaces of the main panel and the housing which are coupled to each other. The manipulation cover includes a display section formed therein to correspond to any one of the installation openings of the housing and pressing sections formed thereon so as to press the incision portions of the housing. The main panel is actuated by unfolding the folded external cover, so that the contents stored in the memory are output as video and voice.

The main panel includes a printed circuit board (PCB), a power supply unit disposed at one side of the lower portion of the PCB and configured to supply power, a video output unit disposed at one side of an upper portion of the PCB and configured to output video stored in the memory, a voice output unit disposed at the other side of the upper portion of the PCB and configured to output voice stored in the memory, a switch configured to turn on/off the PCB when the external cover is unfolded and folded, and buttons disposed on a top surface of the PCB so as to allow a user to easily control the video and voice output from the video output unit and the voice output unit.

The power supply unit is mounted to the PCB or further includes a power input unit connected to an external power supply.

The PCB also includes an input port that allows the invention to be connected to an external memory device.

The input section includes a memory card input unit into which a memory card is inserted, and a memory device input unit to which a portable memory device is connected.

Furthermore, each of the PCB, the power supply unit (battery) for supplying power source, the video output unit (LCD) for outputting video stored in the memory, and the voice output unit (speaker) for outputting voice stored in the memory has a thickness of about 2 to 3 mm. Thus, if the components are not stacked onto the PCB like traditional boards, the total thickness of the digital video greeting card is within a range from about 3 to 7 mm after the assembly of the components.

BRIEF DESCRIPTION OF THE DRAWINGS

Further objects and advantages of the invention can be more fully understood from the following detailed description taken in conjunction with the accompanying drawings in which:

FIG. 1 is a perspective view showing a digital video greeting card in accordance with the present invention in a state where a outside cover is folded;

FIG. 2 is a perspective view showing the digital video greeting card in accordance with the present invention in a state where the outside cover is unfolded;

FIG. 3 is an exploded perspective view of the digital video greeting card in accordance with the present invention;

FIG. 4 is a perspective view showing a main panel of the digital video greeting card in accordance with the present invention;

FIG. 5 is an exploded perspective view showing the main panel of the digital video greeting card in accordance with the present invention;

FIG. 6 is a bottom view showing the digital video greeting card in accordance with the present invention in a state where an external cover is folded; and FIG. 7 is a bottom view showing the digital video greeting card in accordance with the present invention in a state where the external cover is opened for use.

EXPLANATION ON REFERENCE NUMERALS OF MAIN ELEMENTS IN THE DRAWINGS

| | |
|---|---|
| 10: digital video greeting card | 100: main panel |
| 110: PCB | 120: power supply unit |
| 130: video output unit | 140: voice output unit |
| 150: switch | 160: manipulation buttons |
| 170: input section for external data | 172: memory card input unit |
| 174: memory device input unit | 200: housing |
| 210: installation opening | 220: incision sections |
| 300: base cover | 400: manipulation cover |
| 410: display section | 420: pressing section |
| 500: outer cover | |

DETAILED DESCRIPTION OF THE PREFERRED EMBODIMENT

The present invention will now be described in detail in connection with specific embodiments with reference to the accompanying drawings.

The present embodiment does not limit the right of the present invention, but is only illustrative and can be modified in various ways without departing from the scope and spirit of the present invention.

FIG. 1 is a perspective view showing a digital video greeting card in accordance with the present invention in a state where a manipulation cover is folded over the main panel. FIG. 2 is a perspective view showing the digital video greeting card in accordance with the present invention in a state where the manipulation cover is unfolded. FIG. 3 is an exploded perspective view of the digital video greeting card in accordance with the present invention. FIG. 4 is a perspective view showing a main panel of the digital video greeting card in accordance with the present invention. FIG. 5 is an exploded perspective view showing the main panel of the digital video greeting card in accordance with the present invention. FIG. 6 is a bottom view showing the digital video greeting card in accordance with the present invention in a state where an external cover is folded. FIG. 7 is a bottom view showing the digital video greeting card in accordance with the present invention in a state where the external cover is open for use.

As shown in the drawings, a digital video greeting card 10 includes a main panel 100, a housing 200, a base cover 300, a manipulation cover 400, and an external cover 500. The main panel 100, includes a self-power source and a memory, and outputs contents stored in the form of video and voice.

The housing 200 is attached to the main panel and is configured to cover a top portion of the main panel 100. The housing 200 includes a plurality of installation openings 210 formed therein and a plurality of incision sections 220 formed thereon. A plurality of components installed on the main panel 100 is inserted into the plurality of installation openings 210 in such a manner that the respective components protrude to the outside through the installation openings.

A part of the edge of each of the incision sections 220 of the housing 200 is integrally connected to a body of the housing 200 and the remaining portions thereof are incised in an opened loop shape. If pressure is downwardly applied to the incision section 220 and then the applied pressure is removed, the incision section 220 returns to its original position.

Furthermore, the base cover 300 is fixed to the bottom of the main panel 100 and the housing 200, which are attached to each other. The manipulation cover 400 covers the top of the main panel 100 and the housing 200, which are attached to each other. The outer cover 500 is configured to cover one side of the main panel 100 and the housing 200 and an outer surface of the manipulation cover 400.

The manipulation cover 400 includes a display section 410 formed therein and a plurality of pressing sections 420 formed thereon. The display section 410 is disposed to correspond to any one of the installation openings 210 of the housing 200, and the pressing sections 420 is disposed to correspond to the incision sections 220 of the housing 200.

That is, a video output unit (for example, a liquid crystal display (LCD)), which is seen through the installation openings 210 of the housing 200, can be exposed externally through the display section 410 of the manipulation cover 400. When the pressing section 420 of the manipulation cover 400 is pressed, the incision section 220 of the housing 200 is pressed downwardly to cause the main panel 100 to be manipulated.

Here, only a part of the pressing section 420 of the manipulation cover 400 is integrally connected to a body of the manipulation cover 400 and the remaining portions thereof are incised in a wedge shape, in the same manner as the incision sections 220 of the housing 200, so that the pressing section 420 has elasticity.

Meanwhile, the pressing section 420 of the manipulation cover 400 can be moved in a direction different from that of the incision section 220 of the housing 200. In other words, it is preferred that the movement direction of the pressing section 420 differs from that of the incision section 220.

This is aimed to prevent malfunction of the digital video greeting card. That is, in the case where the incision sections 220 is downwardly pressed by applying pressure to the pressing section 420, if they are moved in the same direction, the incision section 220 loses its elasticity due to excessive pressing and comes into close contact with the top surface of the main panel 100 with the incision section 220 bent.

Furthermore, the external cover 500 is folded in such a way as to selectively cover the manipulation cover 400 disposed on the top surface of the main panel 100 and the housing 200, which are coupled to each other. When the digital video greeting card is not used, the outer surface of the manipulation cover 400 disposed on the top surface of the housing 200 is covered by the external cover 500 which has been completely folded, and when the digital video greeting card is used, the outer surface of the manipulation cover 400 is exposed externally by the unfolding operation of the external cover 500.

In other words, the external cover 500 can control the operation of the main panel 100 by selectively allowing the current to flow through the main panel 100 or interrupting the current flowing through the main panel 100.

As shown in FIG. 4, the main panel 100 includes a printed circuit board (PCB) 110, a power supply unit 120, a video output unit 130, a voice output unit 140, and a switch 150. Furthermore, the power supply unit 120 is disposed on one side of a lower portion of the PCB 110 so as to apply power to the digital video greeting card. The video output unit 130 and the voice output unit 140 are respectively disposed at both sides of an upper portion of the PCB 110.

Here, the power supply unit 120, the video output unit 130 and the voice output unit 140 are disposed in parallel with the PCB 110 in such a manner that their lateral portions face one another. Here, the PCB 110 is cut with notches at positions thereof, whose shapes correspond to the shapes of the power supply unit 120, the video output unit 130 and the voice output unit 140.

This is aimed to reduce the thickness of the main panel 100. The lateral portions of the power supply unit 120, the video output unit 130 and the voice output unit 140 are disposed to face the PCB 110, so that the thickness of the main panel 100 is decided by the thickness of the power supply unit 120, the video output unit 130 and the voice output unit 140.

The switch 150 disposed on the PCB 110 is movably mounted at one end thereof to the PCB 110 and is securely fixed at the other end thereof to the external cover 500. Therefore, as shown in FIGS. 5 and 6, when the external cover 500 rotates pivotally, the other end of the switch 150 is moved to cause the PCB 110 to be turned on/off.

It should be noted that the switch 150 adopts a link-driven structure but can be modified to a switch of a variety of structures such as an electromagnet switch, a push switch and a contactless switch without departing from the scope and spirit of the present invention.

Further, a plurality of manipulation buttons 160 is disposed on a top surface of the PCB 110 so that a user can easily control video and voice output from the video output unit 130 and the voice output unit 140 using the manipulation buttons 160.

In this case, the power supply unit 120, the video output unit 130 and the voice output unit 140 are correspondingly inserted into the installation openings 210 of the housing 200. The manipulation buttons 160 are disposed to correspond to the incision sections 220 of the housing 200.

In other words, the housing 200 and the manipulation cover 300 are formed to conform to the shape of the PCB 110 where the power supply unit 120, the video output unit 130, the voice output unit 140, and the manipulation buttons 160 are formed.

Furthermore, the PCB 110 is further provided with an external input section 170 for connection to an external memory. The external input section 170 includes a memory card input unit 172 and a memory device input unit 174.

The memory card input unit 172 is a slot into which a memory card is inserted and the memory device input unit 174 is a terminal to which a USB connection jack is connected.

Here, the power supply unit 120 is detachably mounted to the PCB 110. When the power supply unit 120 is free of power, it may be replaced with another power supply unit 120 or may be charged with power using a separate charger (not shown).

Further, the power supply unit 120 is further provided with a power input unit (not shown) connectable to an external power supply. Therefore, the power supply unit 120 can be charged with power with it being installed in the PCB 110.

As described above, the total thickness of the respective components which are coupled to each other is within a range from about 3 mm to 7 mm. This is possible because the constituent elements, such as the video output unit 130, the voice output unit 140 and the power supply unit 120, has a thickness of about 2 mm to 3 mm and are combined together to face the PCB 110.

Meanwhile, the base cover 300, the manipulation cover 400 and the external cover 500 can be integrally formed with one another. The manipulation cover 400 is connected to one side of the base cover 300 and the external cover 500 is connected to the other side of the base cover 300.

As described above, the digital video greeting card in accordance with the present invention is flat and thin, allowing it to be inserted into a book, a catalog and so on. Thus, the contents, etc., which cannot be described using text, can be transferred easily as video and voice. Further, the digital video greeting card of the present invention has a function of checking the contents stored in other memory devices, etc., using the data input section and is compatible with other devices. Accordingly, the present invention provides users with very useful effects.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A digital video greeting card comprising:

a main panel having a memory unit, the main panel being configured to output contents stored in the memory unit in the form of video, digital images and audio;

a housing coupled to the main panel and configured to cover a top portion of the main panel, wherein the housing includes a plurality of installation openings formed thereon so as to allow respective components of the main panel to be inserted in such a manner that the respective components protrude through the installation openings, and a plurality of incision sections formed on said housing for pressing manipulation buttons of the main panel;

a base cover fixed to bottom surfaces of the main panel and the housing which are coupled to each other;

a manipulation cover connected to a first side of the base cover and configured to cover top surfaces of the main panel and the housing, wherein the manipulation cover includes a display section formed which corresponds to any one of the installation openings for a video output unit and pressing sections corresponding to the incision sections such that pressing downward on any one of the pressing sections causes a corresponding one of the incision sections to be pressed downward; and an external cover pivotably connected to an opposite side of the first side of the base cover for movement between a first position selectively covering one side of the main panel, the housing and an outer surface of the manipulation cover, wherein the main panel is actuated when the outer surface of the manipulation cover disposed on the top surface of the housing is exposed externally by unfolding the external cover so that the output contents stored in the memory unit are output as video, digital images and audio.

2. The digital video greeting card as claimed in claim 1, wherein the main panel comprises:

a printed circuit board (PCB);

a power supply unit disposed at one side of a lower portion of the PCB and configured to supply power;

the video output unit being disposed at one side of an upper portion of the PCB and configured to output video and digital content stored in the memory unit;

an audio output unit disposed at the other side of the upper portion of the PCB and configured to output audio content stored in the memory unit;

a switch mounted at the PCB and connected to the external cover, the switch configured to activate the main panel to output the video, digital images, and audio when the external cover is unfolded and deactivate the main panel when the external cover is folded; and manipulation buttons disposed on a top surface of the PCB to allow a user to control the video and audio output from the video output unit and the audio output unit, respectively.

3. The digital video greeting card as claimed in claim 2, wherein the power supply unit is detachably mounted to the PCB.

4. The digital video greeting card as claimed in claim 2, wherein the PCB further comprises an external input section connected to an external memory device.

5. The digital video greeting card as claimed in claim 4, wherein the external data input section comprises:

a memory card input unit into which a memory card is inserted; and a memory device input unit to which a portable memory device is connected.

6. The digital video greeting card as claimed in claim 2, wherein the power supply unit comprises a power input unit connected to an external power supply.

7. The digital video greeting card as claimed in claim 1, wherein the thickness of the digital video greeting card is within a range from 3 to 7 mm.

8. A digital video greeting card comprising:

a main panel including a printed circuit board having a plurality of openings for receiving a power source, a video output, an audio output, a memory unit for storing video, digital and audio content;

a plurality of manipulation buttons disposed on the printed circuit board permitting a user to selectively control the video, digital and audio content;

a housing for covering a top surface of the main panel, the housing including a plurality of openings sized to receive corresponding components of the main panel which protrude therethrough, and a plurality of incision sections, which correspond to said plurality of manipulation buttons, formed on said housing for pressing manipulation buttons of the main panel;

a first cover pivotably moveable between a closed position covering the housing and the main panel and an open position uncovering the housing and the main panel, wherein the first cover includes a display section formed which corresponds to one of said openings for a video output unit and pressing sections corresponding to the incision sections such that pressing downward on any one of the pressing sections causes a corresponding one of the incision sections to be pressed downward;

a second cover pivotably moveable between a closed position interrupting current flow through the main panel and an open position allowing current flow through the main panel; and a switch mounted at the printed circuit board and connected to the second cover such that the main panel is deactivated at the close position of the second cover and activated at the open position of the second cover to output the video, digital and audio content as video, digital images, and audio.

* * * * *